US006076741A

United States Patent [19]

Dandrel et al.

[11] Patent Number: 6,076,741

[45] Date of Patent: Jun. 20, 2000

[54] DEVICE FOR RENDERING AT LEAST ONE JET OF WATER LUMINOUS

[76] Inventors: François Paul Dandrel; Geneviève Marie née Duveau Dandrel, both of 12, Chemin Renaudin, 92260 Fontenay aux Roses, France

[21] Appl. No.: 09/019,988

[22] Filed: Feb. 6, 1998

[30] Foreign Application Priority Data

Feb. 12, 1997 [FR] France ..... 97 01620

[51] Int. Cl.[7] ..... F21P 7/00

[52] U.S. Cl. ..... 239/18; 239/289; 239/193; 362/96

[58] Field of Search ..... 239/18–20, 289, 239/193; 362/96

[56] References Cited

U.S. PATENT DOCUMENTS

| | | | |
|---|---|---|---|
| 4,749,126 | 6/1988 | Kessener et al. | 239/18 X |
| 4,901,922 | 2/1990 | Kessener et al. | 239/18 X |
| 4,936,506 | 6/1990 | Ryan | 239/18 |
| 5,078,320 | 1/1992 | Fuller et al. | 239/20 |
| 5,160,086 | 11/1992 | Kuykendal et al. | 239/18 |

FOREIGN PATENT DOCUMENTS

| | | |
|---|---|---|
| 638540 | 5/1928 | France . |
| 1187689 | 9/1959 | France . |
| 1567059 | 5/1969 | France . |
| 2562637 | 10/1985 | France . |
| 2099125 | 12/1982 | United Kingdom . |

*Primary Examiner*—Kevin Weldon
*Attorney, Agent, or Firm*—Dowell & Dowell, P.C.

[57] ABSTRACT

A device for forming and rendering luminous a jet of water projected from the device. An optical lens element is provided through which water is directed before being formed into a jet. The lens element also functions to receive light from light emitting elements which are mounted about an upstream water conductor such that the light is focused on the jet of water.

25 Claims, 4 Drawing Sheets

DEVICE FOR RENDERING AT LEAST ONE JET OF WATER LUMINOUS

BACKGROUND OF THE INVENTION

1. Field of the Invention

The present invention relates to a device for rendering jets of water luminous and to installations equipped with such a device, such as for example fountains, shower installations or cascades.

2. Brief Description of the Related Art

Luminous fountains are known which have one or more jets of water equipped with various devices for rendering these jets luminous. Among these devices the most widely known are aerial sources of light or more usually immersed sources of light such as projectors.

In the case of aerial projectors, an illuminated jet of water is but very slightly visible owing to a considerable loss of the light. Indeed, the major part of the light projected in the direction of the jet passes to one side of the latter. Consequently, only a small part of the light energy produced by the projector really serves to light up the jet. This problem can be overcome with specific optical systems associated with the projectors. But such a solution is usually costly and must be designed for each fountain individually. Further, in this case of lighting, only one side of the jet is really lit up. In order to obtain a homogeneous illumination of the jet of water, i.e. an illumination which is such that an observer has an identical impression of the luminous jet wherever he is situated, it is essential to dispose around the jet a set of several projectors.

With an immersed projector, it is possible to somewhat improve the result of the lighting. But it is found that only the lowermost part of the jet is effectively illuminated. In the case of relatively long jets, this solution does not provide a satisfactory result. Also, as in the case of aerial projectors, it is necessary to dispose several projectors around the jet to light up the latter on all sides, which considerably increases the cost of the device.

There is also known from patent FR-A-2 562 637 belonging to the applicants of the present application, a device for rendering jets of water luminous which comprises, for each jet to be illuminated, a light conductor, such as one or more optical fibers, connected to a source of light. The output end of the conductor whose cross section is small relative to the section of the jet, is disposed within the latter. This device provides a homogeneous illumination of the jets. However, the applicants have noticed that this device can only be applied to jets of water no higher than about 0.5 m.

Further, luminous fountains are known which comprise a tank filled with water provided with an opening toward the bottom of its lateral surface. A lens is inserted in the side of the tank opposite the opening. In order to render the stream of liquid issuing from the opening luminous, the latter is illuminated through the liquid by a convergent beam of light rays obtained by means of the inserted lens which is illuminated by an external source of light. Although this known fountain provides a jet of water which is illuminated in a homogeneous manner, it will be understood that such a construction is costly and for example may be difficult to adapt to existing fountains and in particular fountains having vertical jets of water.

SUMMARY OF THE INVENTION

An object of the invention is to overcome the various aforementioned drawbacks by providing a device for rendering at lest one jet of water luminous in a homogeneous manner in the major part of its path, which is more economical and relatively easy to install, in particular on jets of water of existing fountains.

The invention therefore provides a device for rendering luminous at least one jet of water projected in a direction away from means for forming the jet which are connected to a water supply through water conducting means, comprising means for emitting light rays associated with optical means for orienting toward said jet of water light rays issuing from said emitting means, the emitting means and the associated optical means illuminating said jet of water substantially in the direction of the projection of the latter, characterized in that the optical means comprise a cavity through which the water conducting means extend.

The invention may also have one or more of the following features:

- the cavity is integrated with the water conducting means,
- the optical orienting means for the light rays comprise a focusing lens including the cavity,
- the focusing lens has a plano-convex shape,
- the focusing lens has the shape of a sphere,
- in the case of a flat jet of water, the focusing lens is a cylindrical lens,
- the focusing lens comprises a shell which is made of an optically transparent material and defines the cavity which, in operation, is filled with water by the water conducting means,
- the shell is provided, on one hand, with an inlet opening connected to the water conducting means and, on the other hand, with at least one outlet opening which is part of the means for forming the at least one jet of water,
- each outlet opening forms a nozzle for forming a jet of water,
- the means for forming said at least one jet of water comprise a nozzle for each jet, and at least one nozzle comprises a tube fixed substantially perpendicularly to the surface of the shell in an associated outlet opening of the latter,
- the spherical shell comprises two semi-spherical cups and complementary means for assembling the two cups which resist the pressure of the water in the cavity,
- the focusing lens is formed by a solid body composed of an optically transparent material in which said cavity is provided, the index of refraction of the solid body being higher than that of air, preferably higher than that of water,
- the cavity is arranged in the form of a cylindrical central passage of circular section,
- one end of the central cylindrical passage is connected to water outlet means of the water conducting means, and the other end forms, or is connected to, a nozzle,
- the means for emitting the light rays comprise output means for the light rays disposed at a distance greater than or equal to the focal length f of the optical orienting means, on the upstream side of the latter,
- the means for emitting the light rays comprise a source of light, and light conductors connected by first ends to the source of light, the other ends of which conductors constitute the output means for the light rays,
- the light conductors are formed by a bunch of optical fibers,
- the water supply means comprise a rigid tube maintained in a predefined orientation, disposed on the upstream side of the optical orienting means, centered relative to the optical axis of the optical orienting means and serving as a support, on one hand for the optical orienting means and, on the other hand, for at least one output means of the light rays, the output ends of the light conductors forming the output means of the light rays are fixed around the rigid tube of the water conducting means in such manner as to form an annular light ray emitting unit.

The invention also provides a fountain comprising means for forming at least one jet, a water supply and means for conducting water connecting the supply to the means for forming the at least one jet of water, characterized in that it comprises at least one device of the type defined hereinbefore.

The invention also provides a shower installation comprising a shower head, characterized in that it comprises at least one device of the type defined hereinbefore and the optical orienting means form the shower head.

The invention further provides a cascade comprising means for forming a flat jet of water, characterized in that it comprises at least one device of the type defined hereinbefore.

BRIEF DESCRIPTION OF THE DRAWINGS

Further features and advantages of the invention will be apparent from the following description which is given merely by way of a non-limitative example with reference to the accompanying drawings in which.

DESCRIPTION OF THE PREFERRED EMBODIMENT

Figure 1:
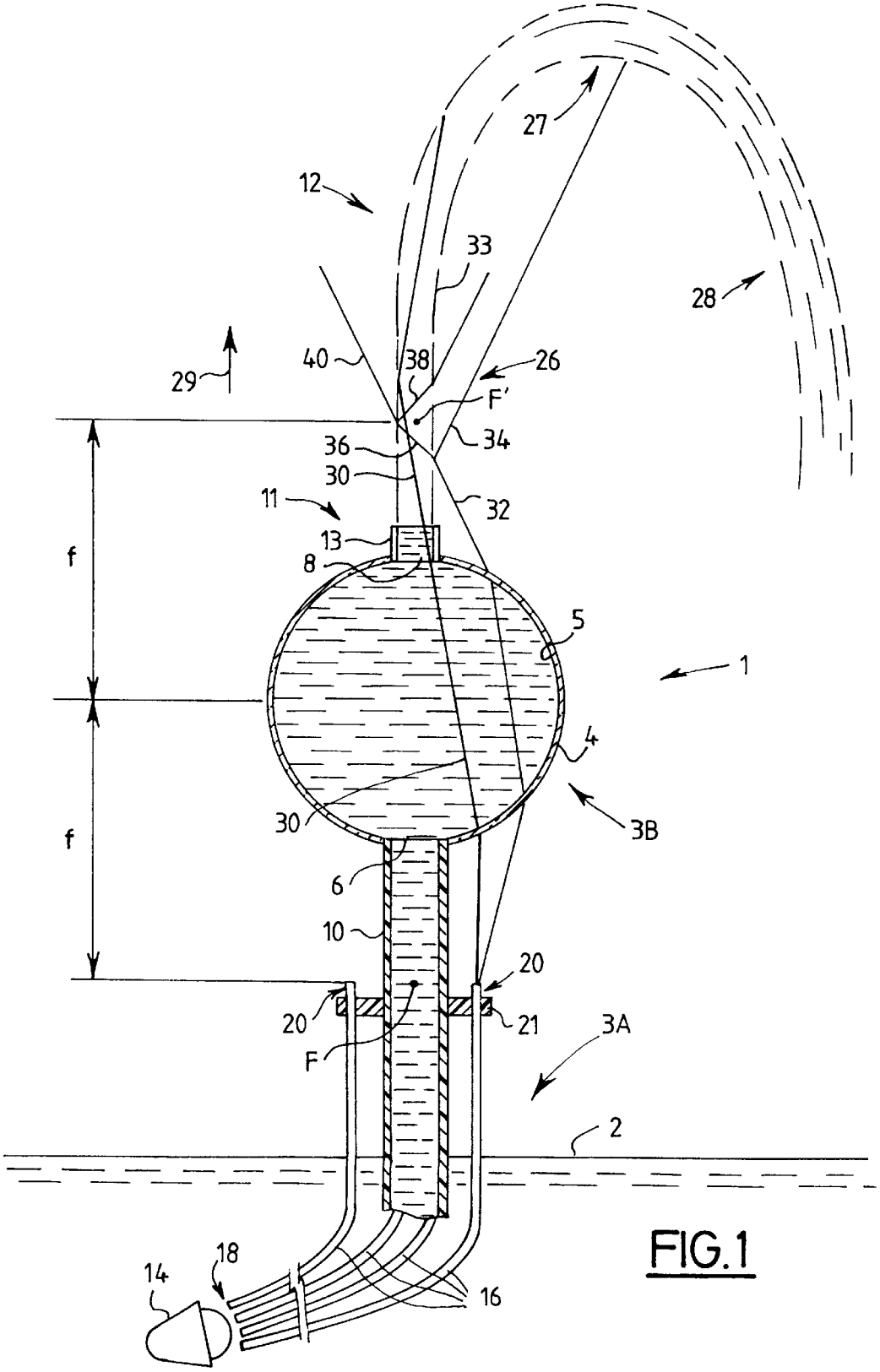
FIG. 1 is a schematic view partly in section of the device according to the invention.

Shown in FIG. 1 is a device 1 according to the invention which is installed in a fountain of which only the water level 2 of its basin is shown.

The device 1 comprises means 3A for emitting rays of light and an associated focusing lens 3B. The lens 3B is formed by a shell or container 4 of spherical shape which is composed of an optically transparent material, such as a plastic material or glass which defines an inner cavity 5 filled with water during the operation of the fountain.

For this purpose, the spherical shell 4 comprises at the bottom a water inlet opening 6 and at the top a water outlet opening 8. These openings are therefore formed in the shell 4 at diametrally opposed points. The section of the inlet opening 6 is slightly larger than that of the outlet opening 8.

The cavity 5 of the shell 4 is connected to a water supply (not shown) through a water conducting tube 10 fixed in a sealed manner in the opening 6.

A nozzle 11 for forming an ascending jet of water 12 is formed by a tube 13 which is fixed in a sealed manner and perpendicularly to the outer surface of the shell in the outlet opening 8. This nozzle 11 is therefore connected to the water supply via the inner cavity 5 and the water conducting tube 10.

Preferably, the tubes 10 and 13 are also made from an optically transparent material.

The means 3A for emitting light rays comprise a source of light 14 and a bunch of optical fibers 16. The input ends 18 of the optical fibers 16 are connected to the source of light 14 and the ends 20, namely the light ray output ends, are fixed by means of a ring 21 around the water conducting tube 10 so that they form an annular unit for emitting light rays in the direction toward the spherical shell 4.

During the operation of the fountain, the water coming from the water supply means gradually fills, via the water conducting tube 10, the inner cavity 5 of the spherical shell 4 and is ejected through the nozzle 11 into the surrounding air and forms a jet of water 12. In the presently-described embodiment, the jet of water 12 has a parabolic shape with a ascending part 26, an top part 27 and a descending part 28.

Owing to the fact that the index of refraction of water, which is $n_{water}$=1.33, is higher than that of the air surrounding it ($n_{air}$=1), the shell 4 filled with water constitutes a focusing lens. This focusing lens has two focal points F and F' located respectively on the upstream and downstream sides of the lens at a focal distance f. The optical axis of the lens is defined by a straight line passing through these two focal points F and F'. The light rays issuing from the ends 20 of the optical fibers 16 are therefore directed by the lens toward the jet 12 and illuminate the latter substantially in its direction of projection indicated by the arrow 29. In view of the fact that the shell 4 filled with water is a thick lens, its focal length f is calculated from the following relation:

$$f = \frac{n_{water}}{(n_{water} - 1)} \frac{R}{2}$$

where R is the radius of the spherical shell 4. In this relation, the small thickness of the walls of the spherical shell 4 have been neglected.

The spherical shape of the focusing lens formed by the shell 4 filled with water is advantageous since such a shell has a large numerical aperture approaching 0.5. Owing to this large numerical aperture, the focusing lens is capable of receiving a maximum of light energy emitted by the ends 20 of the optical fibers 16 and therefore optimizes the ratio between the light energy produced by the source 14 and that serving really to render the jet of water 12 luminous.

Another important feature of the optical mounting of the device according to the invention concerns the positioning of the ends 20 of the optical fibers relative to the focusing lens formed by the spherical shell 4 filled with water. Preferably, the ends 20 are positioned at a distance equal to or greater than the focal length f of the focusing lens calculated by means of the aforementioned relation. More particularly, in the case of a very high jet of water the ends will be chosen to be positioned at the focal length f from the lens (see FIG. 1) so as to obtain beyond the focal point F' on the downstream side of the lens a beam of light rays which are of small divergence or even parallel while, in the case of a jet of water which is less high but wider, they will be placed at a distance exceeding the focal length so that the light rays illuminate substantially the whole of the volume occupied by the jet of water.

The operation of the device will now be explained with the aid of two examples of light rays 30 and 32 issuing from the ends 20 of the optical fibers 16 at a different output angle.

After a refraction at the shell/air interface, the light ray 30 travels through the water contained in the spherical cavity 5, directly enters the jet of water 12 and propagates along the inside of the latter by multiple reflections on the water/air interface of the jet 12. Indeed, the jet of water 12 projected into the air behaves in the manner of a light conductor owing to the fact that the index of refraction of air is lower than that of water, as mentioned before. Upon these multiple reflections, a part of the light energy escapes along the jet which contributes to rendering the latter luminous.

The light ray 32 is propagated in a more eccentric manner relative to the center of the shell 4 than the ray 30. It is refracted at each interface between the shell 4 and the air and is directed toward the periphery 33 of the jet of water. When this ray 32 encounters the periphery 33 of the jet 12, i.e. the air/water interface of the jet, a first part 34 of the ray is reflected thereby contributing to rendering the jet of water 12 luminous in this region. This first part 34 also serves, according to its path, to render luminous the top part 27 or the descending part 28 of the jet of water 12. A second part 36 of the ray 32 enters the jet 12. After having travelled through the jet of water, the second part 34 again encounters the periphery 33 of the jet and this ray 36 is then divided into a first part 38 reflected toward the interior of the jet and a second part 40 which escapes from the jet 12 and renders the latter luminous in the region of its exit. The second part 38 propagates inside the ascending part 26 of the jet, as was explained in respect of the propagation of the light ray 30.

It will therefore be understood that the jet of water is rendered luminous, on one hand, owing to the external reflections on the periphery of the jet of water and, on the other hand, owing to the light rays which are propagated inside the jet. Owing to the fact that the light rays issue from the optical fiber in the form of a beam of rays the divergence of which is typically 60°, it is possible to illuminate homogeneously the jet of water 12 on the major part of its parabolic path, the top part 27 and the descending part 28 of the jet being essentially illuminated by the parts of the light rays which are reflected at the water/air interface or the air/water interface of this part.

Figure 2:
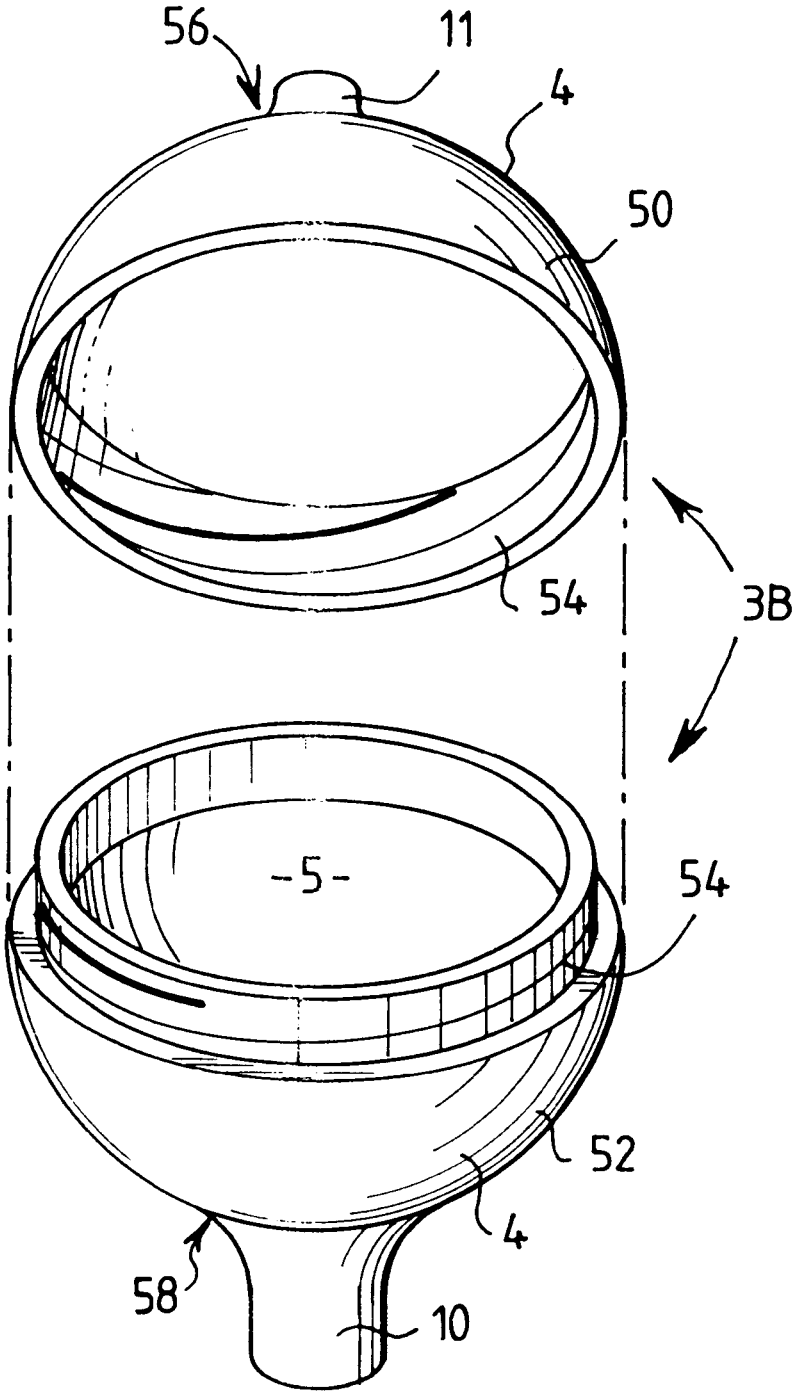
FIG. 2 is a perspective exploded view of an improvement of a part of the device of FIG. 1.

If the fountain is supplied with a rather calcerous water, the spherical shell 4 is liable to beecome rather rapidly opaque owing to a deposit on the inner surface of the shell 4. In order to facilitate access to the interior of the sphere for cleaning the inner cavity 5, the applicants propose designing the spherical shell 4 in the manner shown in FIG. 2.

In this embodiment, the spherical shell 4 is made in two semi-spherical cups or domes 50 and 52 provided with complementary assembling means 54. These means 54 are for example means for assembling by screwing which permits locking one cup against the other and preventing an accidental separation of the cups when the water pressure in the cavity is high. The semi-spherical cups 50 and 52 are composed of an optically transparent plastic material.

Advantageously, the upper cup 50 includes at the top 56 a nozzle 11 which is in one piece with the cup. Likewise, the lower cup 52 has at the bottom 58 a water inlet tube 10 in one piece with the lower cup.

When this device is installed on an existing fountain, the water inlet tube 10 is connected, for example to an existing nozzle of the fountain and maintained in position by means of a support (not shown). At this stage, it is already possible to carry out a first test for orienting and controlling the jet of water projected from the nozzle 11. Lastly, the output ends of the fiber optics are fixed by means of the fixing ring 21 at the appropriate distance, as explained hereinbefore, so as to form an annular light ray emitting unit. This assembly has the advantage that the water inlet tube 10 is automatically centered relative to the optical axis of the focusing lens and serves as a support not only for the output end 20 of the optical fibers but also for the lens 3B itself. It will be understood that the device according to the invention is easy to install and may be adapted to a multitude of existing fountains.

Figure 3:
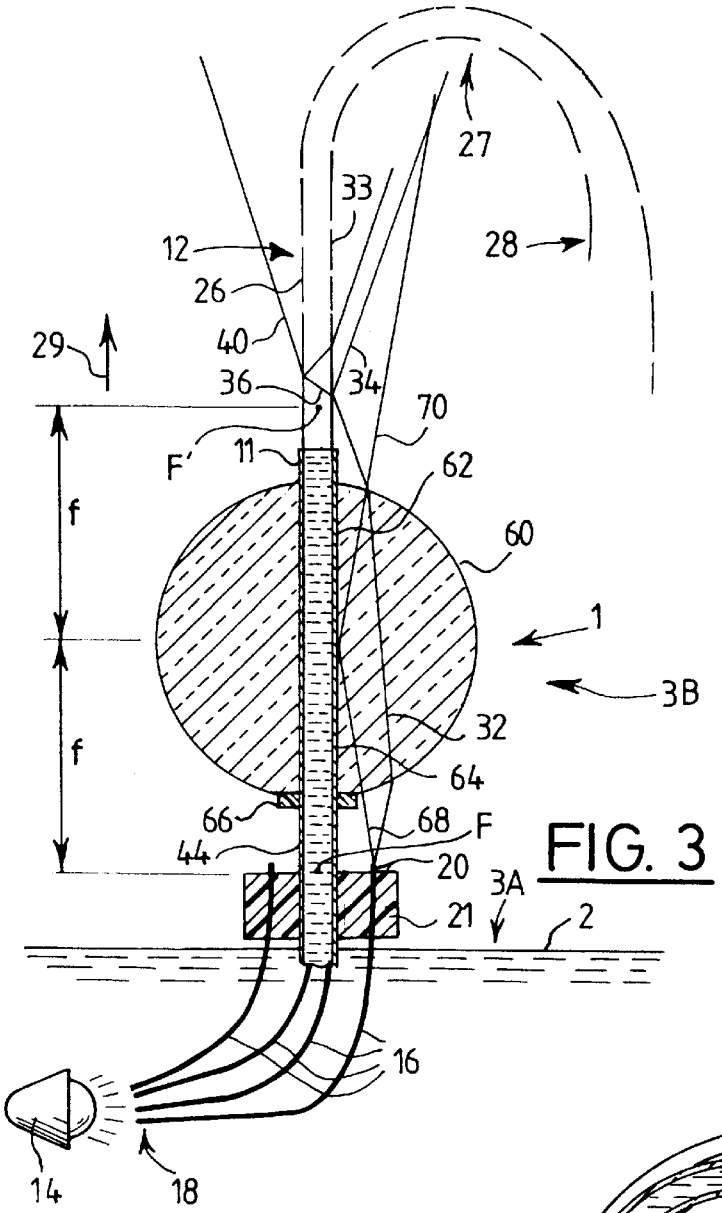
FIG. 3 is a schematic view partly in section of a variant of the device according to the invention.

FIG. 3 shows another embodiment of the device 1 according to the invention. In this Figure, elements identical to those of FIGS. 1 and 2 carry the same reference numerals.

This device comprises as a focusing lens a ball 60 composed of an optically transparent material whose index of refraction is higher than that of air, in particular higher than that of water, such as for example glass or a plastic material. Provided in this ball 60 is a central cylindrical pipe 62 having a circular cross-sectional shape. The ball 60 is mounted on a tube 64 of water conducting means connected to a water supply (not shown). Preferably, this tube 64 is rigid and made from an optically transparent material. Its upper end constitutes a nozzle 11 for forming the jet of water. The ball 60 is maintained in position, on one hand, by the tube 64 on which it is mounted and, on the other hand, by a flange 66 mounted on the tube 64. The ball 60 rests against the flange 66 so that there is no vertical displacement thereof. The nozzle 12 only slightly extends beyond the top of the ball 60. The optical fibers 16 are fixed around the tube 64, as explained hereinbefore with reference to FIG. 1. It will be understood that, when positioning the ends 20 of the optical fibers 16, there must be taken into account that the focal length of the ball is calculated in this case with the index of refraction of the material from which the ball is made.

The operation of this device is equivalent to that of the device shown in FIG. 1 except that light rays 64 which are equivalent to the rays 30 of FIG. 1, undergo a total reflection at the interface between the tube64 and the water in the latter. The reflected part 70 will serve essentially to illuminate the top part 27 and the descending part 28 of the jet.

This embodiment has the advantage that the focusing lens formed by the ball 60 does not become opaque from the interior during the operation of the fountain. Further, such a ball composed of glass or a plastic material can be easily cleaned. Moreover, this embodiment is just as easily adapted to existing fountains.

As a variant, the pipe 62 may be connected directly to the tube 64. In this case, the pipe 62 serves with its outlet end as a nozzle forming the jet of water.

In another variant, it is proposed to construct the focusing lens with assembled segments of a sphere defining a cavity or passage through which extends in a centered manner relative to the optical axis of the lens, a tube of the water conducting means. As long as these assembled segments have a lens effect on the light rays issuing from the optical fibers which is comparable to that of the ball 60 of FIG. 3, the operation of the device according to the invention is unmodified.

In the embodiments of FIGS. 1 and 3, the focusing lens was disposed in the air. However, it is also possible to dispose it partly in water. In this case, the focal length of the lens is varied in accordance with the water level according to well-known optical laws. Such an arrangement may be found to be of interest in the case where it is also desired to illuminate the basin of the fountain from which the jet of water 12 is projected. Indeed, in the case of a partly immersed lens, a part of the light rays is reflected at the shell/water or ball/water interface, so that the bottom of the basin is also illuminated.

In the case of the device of FIG. 3, it is also envisaged to completely immerse the ball so that only the nozzle 12 extends above the surface of the water. Owing to the fact that the index of refraction of the glass or of the plastic material is higher than that of water, the ball 60 again acts as an optical lens. On the other hand, the focal length of this optical element is now calculated by taking into account the ratio of the indices of refraction between the material of the ball and the water instead of that between the material of the ball and the air. In this case, the light ray concentrating power of the ball 60 diminishes and this consequently increases the focal length.

An advantageous arrangement of the device consists for example in providing the spherical shell 4 shown in FIG. 1 with a plurality of nozzles, such as simple outlet openings, to achieve a group of jets of water rendered luminous.

Figure 4:
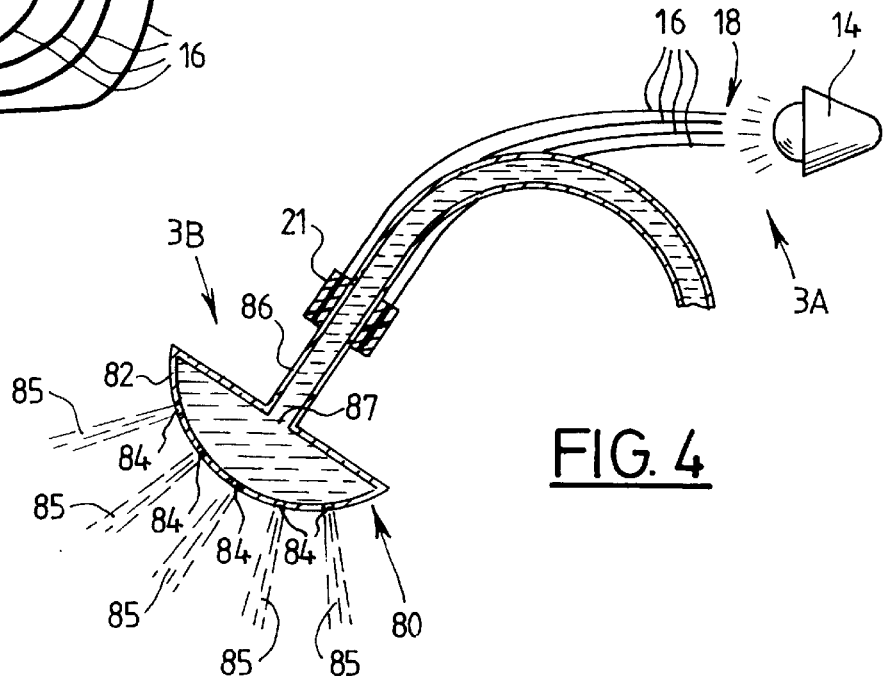
FIG. 4 is a schematic view partly in section of another variant of the device according to the invention.

Shown in FIG. 4 is a shower installation which comprises a device according to the invention. Elements identical to those of FIGS. 1 to 3 carry the same reference numerals.

In this case, the focusing lens of the device is formed by a shell 80 of plano-convex shape composed of an optically transparent material and forming a shower head. For this purpose, in the convex part 82, the shell 80 has a plurality of outlet openings 84 forming water jets 85. The shell 80 is supplied with water through a water inlet tube 86 fixed in an inlet opening 87 which is central in the planar part 88 of the shell 80. The sum of the sections of the outlet openings 84 is less than the section of the inlet opening 87. The optical fibers are fixed by means of the ring 21 in a position around the tube 86 slightly beyond the focal length of the plano-convex lens formed by the shell 80 filled with water. This device operates in the same way as the device of FIG. 1.

If such a shell head is used, it is found that the jets issuing from the head are illuminated throughout their length up to the place where they strike the ground where they form as many luminous points, so that it is possible, by astutely arranging the nozzles, to obtain on the ground a luminous projection giving the image of the nozzles which may be for example an advertisement image, etc.

Various improvements in the device according to the invention are possible without departing from the scope of this patent. For example, it can be arranged to choose sources of light whose colour changes. Further, a plurality of sources of light may be used each one of which has a different emission of color and light rays of different color may be selectively introduced in the optical fibers to obtain a pattern or a desired sequence of colors.

The device according to the invention is distinguished by the simplicity of installation. Indeed, it is possible to install it on the majority of existing fountains with minor modifications of the nozzles of the fountains. Either the device shown in FIG. 1 is used in which the shell is fixed on an existing nozzle, or the outlet of the nozzle of the fountain is provided with a tube adapted to allow the ball 60 to be mounted thereon.

Figure 5:
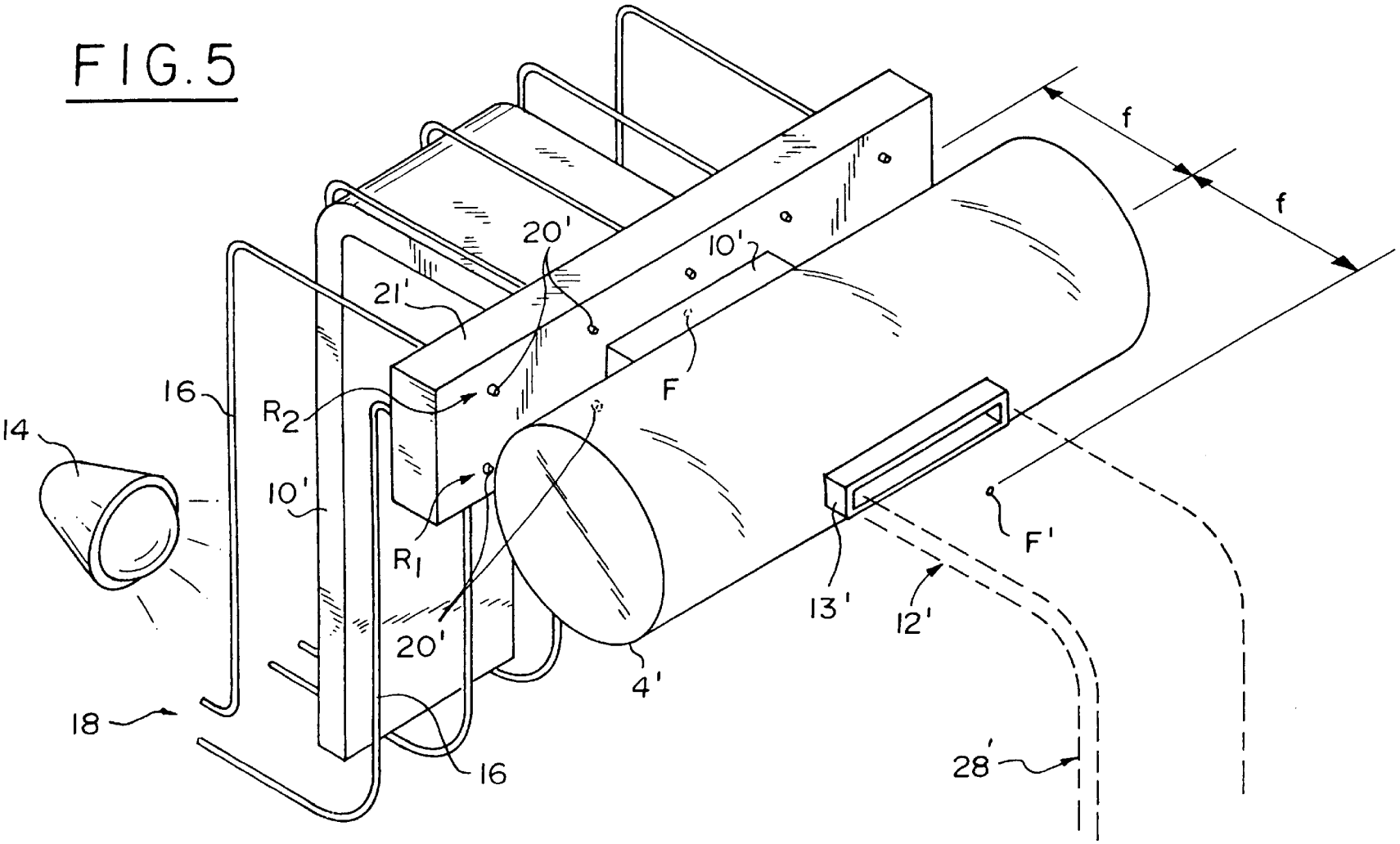
FIG. 5 is a perspective illustrational view showing a cascade fountain in accordance with the invention.

Another variant of interest consists of the adaptation of the device to a cascade fountain such as shown in FIG. 5. In this variant, a flat jet of water 12' having a descending part 28' issues from a rectangular section passage 13' issuing from a spherical lens 4'. This cylindrical lens may be constructed in the same way as the lenses of FIGS. 1, 3 and 4. In this variant, the optical fibers 16 are arranged in rows "$R_1$" and "$R_2$" disposed on each side of the flat jet 12' and illuminate the latter in the same way as explained with reference to FIGS. 1, 3 and 4. The input ends 18 of the optical fiber 16 are illuminated by a source of light 14. The outer ends 20' of the optical fibers are mounted through a support member 21' which is mounted around a water conducting tube 10' through which water is conveyed to the cylindrical lens 4'.

What is claimed is:

1. Device for forming and illuminating at least one jet of water said device comprising in combination:

means for forming and emitting at least one jet of water from the device including conductor means adapted to conduct water from a water supply source, means functioning as a light focusing lens oriented toward said at least one jet emitted from the device, said means for forming and emitting including a fluid passageway through said means functioning as a light focusing lens, emitting means for emitting light rays, said emitting means and said means functioning as a light focusing lens being adapted and arranged to illuminate the at least one jet substantially in a direction of projection thereof, said emitting means including a source of light and light conductors having first ends positioned to receive light from said source of light and second ends which constitute output means for the light rays, and said second ends of said light conductors beinf positioned about said water conductor means and being oriented so as to direct light rays emitted therefrom through said means functioning as a light focusing lens.

2. Device according to claim 1, wherein said light conductors include a plurality of optical fibers.

3. Device according to claim 1, wherein said water conductor means includes a rigid tube which is maintained in a predefined orientation disposed on an upstream side of said means functioning as a light focusing lens and centered relative to an optical axis of said means functioning as a light focusing lens, and means for supporting said light conductors to said tube.

4. Device according to claim 3, wherein said second ends of said light conductors are supported by said rigid tube in such manner as to form an annular light emitting array.

5. Device according to claim 4, wherein said means functioning as a light focusing lens defines a cavity which is integral with said fluid passageway.

6. Device according to claim 1, wherein said means functioning as a light focusing lens includes a cavity which is integral with of said fluid passageway.

7. Device according to claim 6, wherein said means functioning as a light focusing lens has a plano-convex shape.

8. Device according to claim 6, wherein said means functioning as a light focusing lens has the shape of a sphere.

9. Device according to claim 6 wherein said means functioning as a light focusing lens has a cylindrical shape.

10. Device according to claim 6, wherein said means functioning as a light focusing lens includes a shell which is made from an optically transparent material and defines said cavity which, in operation of said device, is filled with water flowing through said water conductor means.

11. Device according to claim 10, wherein said shell includes a liquid inlet opening and at least one outlet opening through which said at least one jet of water is emitted.

12. Device according to claim 11, wherein said at least one outlet opening defines a fluid nozzle.

13. Device according to claim 11, wherein said means for forming said at least one jet of water includes a tube fixed substantially perpendicularly to a surface of said shell aligned with said at least one outlet opening of said shell.

14. Device according to claim 8, wherein said means functioning as a focusing lens comprises a shell made from an optically transparent material and which defines said cavity which, in operation of said device, is filled with water from said water conductor, said spherical shell including two semi-spherical cups and complementary means for assembling said two cups, which complementary means resists pressure of water in said cavity.

15. Device according to claim 1, wherein said means functioning as a focusing lens is formed by a substantially solid body composed of an optically transparent material through which said fluid passageway extends, said solid body having an index of refraction which is higher than the index of refraction of air.

16. Device according to claim 1, wherein said means functioning as a focusing lens is formed by a substantially solid body composed of an optically transparent material through which said fluid passageway extends, said solid body having an index of refraction which is higher than the index of refraction of water.

17. Device according to claim 15, wherein said fluid passageway is a cylindrical central passageway of circular section.

18. Device according to claim 17, wherein said cylindrical central passageway has a first end connected to water inlet means of said water conductor means, and a second end which is connected to a jet-forming nozzle.

19. Device according to claim 16, wherein said cylindrical central passageway has a first end connected to water inlet means of said water conductor means, and a second end which defines a jet-forming nozzle.

20. Device according to claim 1, wherein said output means are disposed on an upstream side of said means functioning as a focusing lens at a distance which is at least equal to the focal length "_f_" of said means functioning as a focusing lens.

21. A fountain comprising means for forming and illuminating at least one jet of water comprising in combination:

means for forming and emitting at least one jet of water from the fountain including conductor means adapted to conduct water from a water supply source, means functioning as a light focusing lens oriented toward said at least one let emitted from the fountain, said means for forming and emitting including a fluid passageway through said means functioning as a light focusing lens, emitting means for emitting light rays, said emitting means and said means functioning as a light focusing lens being adapted and arranged to illuminate said at least one jet substantially in a direction of a projection thereof, said emitting means including a source of light and light conductors having first ends adjacent to said source of light and second ends which constitute output means for the light rays, and said second ends of said light conductors being positioned about said water conductor means and being oriented so as to direct light rays emitted therefrom through said means functioning as a light focusing lens.

22. A shower installation comprising in combination: a showerhead including means for forming at least one jet of water projected in a direction away from said showerhead, water conducting means adapted to connect said showerhead to a water supply, said showerhead including a body of transparent material defining a light focusing lens, emitting means for emitting light rays, said emitting means and said focusing lens being adapted and arranged to illuminate said at least one jet substantially in the direction of the projection thereof, said emitting means comprising a source of light and light conductors having first ends for receiving light from said source of light and second ends which constitute output means for the light rays, and said focusing lens including a cavity for receiving water from said water conducting means.

23. The shower installation of claim 22 said wherein second ends of said light conductors are mounted in an annular array about said water conductor means.

24. The shower installation of claim 22 wherein said body of said focusing lens is plano-convex in shape.

25. A cascade comprising in combination: flat jet forming means for projecting at least one flat jet of water in a direction away from said flat jet forming means, water conducting means comprising means including a water conducting tube maintained in a predefined orientation to connect said flat jet forming means to a water supply, and at least one device for rendering luminous the at least one flat jet of water, said at least one device including emitting means for emitting light rays, a cylindrical focusing lens for orienting towards said at least one flat jet light rays emitted by said emitting means, said emitting means and said focusing lens being adapted and arranged to illuminate the at least one flat jet substantially in the direction of the projection thereof, said emitting means comprising a source of light and light conductors having first ends optically positioned adjacent to said source of light and second ends which constitute output means for the light and are arranged in rows disposed on each side of the flat jet, and said focusing lens adapted for receiving light rays from said output means defining a cavity having a water inlet opening coupled to said water conducting tube and at least one water outlet opening coupled to said jet forming means.

* * * * *